US011749476B2

(12) United States Patent
Ajouhy et al.

(10) Patent No.: US 11,749,476 B2
(45) Date of Patent: Sep. 5, 2023

(54) ELECTRICAL UNIT WITH TURN-OFF SWITCH AND SYSTEM

(71) Applicant: Lear Corporation, Southfield, MI (US)

(72) Inventors: Ayoub Ajouhy, Mohammedia (MA); Michael Haggerty, Grand Blanc, MI (US); Abdelmouneim Charkaoui, Marrakesh (MA)

(73) Assignee: LEAR CORPORATION, Southfield, MI (US)

( * ) Notice: Subject to any disclaimer, the term of this patent is extended or adjusted under 35 U.S.C. 154(b) by 195 days.

(21) Appl. No.: 17/395,036

(22) Filed: Aug. 5, 2021

(65) Prior Publication Data

US 2023/0038302 A1 Feb. 9, 2023

(51) Int. Cl.
*H01H 33/59* (2006.01)
*H01H 7/14* (2006.01)

(52) U.S. Cl.
CPC ..... *H01H 33/596* (2013.01); *H01H 7/14* (2013.01)

(58) Field of Classification Search
CPC ..... H01F 2007/1866; H01F 2007/1888; H01F 7/064; H01F 7/081; H01F 7/1805; H01H 2047/006; H01H 33/596; H01H 47/002; H01H 47/02; H01H 47/04; H01H 47/22; H01H 47/32; H01H 47/325; H01H 7/14;
(Continued)

(56) References Cited

U.S. PATENT DOCUMENTS 4,581,544 A * 4/1986 Feldman ..... H03K 5/08 327/227
4,812,945 A * 3/1989 D'Onofrio ..... H01H 47/22 361/194

(Continued)

FOREIGN PATENT DOCUMENTS

CN 201185404 Y 1/2009
DE 102005037470 A1 2/2007

(Continued)

OTHER PUBLICATIONS

Wikipedia: Chopper (electronics), <https://en.wikipedia.org/wiki/Chopper_(electronics)>, accessed May 14, 2021.

(Continued)

*Primary Examiner* — Jared Fureman
*Assistant Examiner* — Nicolas Bellido
(74) *Attorney, Agent, or Firm* — Fishman Stewart PLLC

(57) ABSTRACT

An electrical unit may include a current controller including an electrical regulator, a control circuit connected to a first input of the electrical regulator, a timer connected to a second input of the electrical regulator, and/or a turn-off circuit including a turn-off switch. The current controller may be configured to provide a first output signal in a first mode and a second output signal in a second mode. The current controller may be configured to transition from the first mode to the second mode based on a timer output of the timer. An electrical system may include an electrical unit and or a switch connected to the electrical unit. The switch may include a coil. The electrical unit may be configured to provide the first output signal to the coil in the first mode and provide the second output signal to the coil in the second mode.

18 Claims, 7 Drawing Sheets

(58) Field of Classification Search
CPC ..... H02J 3/322; H02M 1/14; H02M 1/32; H02M 3/04; H02M 3/156; H03K 3/037; Y02T 10/70
See application file for complete search history.

(56) References Cited

U.S. PATENT DOCUMENTS

| | | | | |
|---|---|---|---|---|
| 7,245,474 | B2 | 7/2007 | Bolz et al. | |
| 8,723,473 | B2 | 5/2014 | Xu et al. | |
| 8,786,998 | B2 | 7/2014 | Song | |
| 8,935,114 | B2 | 1/2015 | Beer et al. | |
| 9,437,381 | B2 | 9/2016 | Hassan-Ali et al. | |
| 9,777,864 | B2 | 10/2017 | Etzler | |
| 9,834,102 | B2 | 12/2017 | Nakaya | |
| 10,900,391 | B2 | 1/2021 | Etzler | |
| 10,907,562 | B2 | 2/2021 | Chia et al. | |
| 2005/0024102 | A1* | 2/2005 | Kondo | H01H 47/002 327/110 |
| 2009/0080133 | A1* | 3/2009 | Chaudhuri | H01H 47/223 361/152 |
| 2010/0193036 | A1 | 8/2010 | Haggenmiller et al. | |
| 2013/0009464 | A1* | 1/2013 | Firehammer | H02J 7/0031 307/140 |
| 2019/0214205 | A1 | 7/2019 | Mondellini et al. | |
| 2020/0135373 | A1* | 4/2020 | Muhammed | H01F 7/064 |

FOREIGN PATENT DOCUMENTS

| | | | |
|---|---|---|---|
| DE | 102009009619 | A1 | 9/2010 |
| JP | 4719030 | B2 | 7/2011 |

OTHER PUBLICATIONS

Application Note AN-021 Driving the GXV600 Contactor with external PWM, Nov. 2015.
BD906xx-C series: Power Management (2014).
"Need a Current Regulator? Use a Voltage Regulator!", https://www.allaboutcircuits.com/technical-articles/need-a-current-regulator-use-a-voltage-regulator/, Feb. 12, 2018.

* cited by examiner

ELECTRICAL UNIT WITH TURN-OFF SWITCH AND SYSTEM

TECHNICAL FIELD

The present disclosure generally relates to electrical units and systems, including electrical units and systems that may be utilized in connection with operating contactors and/or relays, such as in vehicle applications, for example.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

Some electrical designs are susceptible to performance inconsistency with temperature changes and/or generate large amounts of electromagnetic inference.

There is a desire for solutions/options that minimize or eliminate one or more challenges or shortcomings of electrical units and/or systems. The foregoing discussion is intended only to illustrate examples of the present field and is not a disavowal of scope.

SUMMARY

In embodiments, an electrical unit may include a current controller including an electrical regulator, a control circuit connected to a first input of the electrical regulator, and/or a timer connected to a second input of the electrical regulator. The current controller may be configured to provide a first output signal in a first mode and a second output signal in a second mode. The current controller may be configured to transition from the first mode to the second mode based on an output of the timer. An electrical system may include an electrical unit and/or a switch connected to the electrical unit. The switch may include a coil. The electrical unit may be configured to provide the first output signal to the coil in the first mode and provide the second output signal to the coil in the second mode, which may limit power consumption associated with controlling the switch.

The foregoing and other potential aspects, features, details, utilities, and/or advantages of examples/embodiments of the present disclosure will be apparent from reading the following description, and from reviewing the accompanying drawings.

BRIEF DESCRIPTION OF THE DRAWINGS

While the claims are not limited to a specific illustration, an appreciation of various aspects may be gained through a discussion of various examples. The drawings are not necessarily to scale, and certain features may be exaggerated or hidden to better illustrate and explain an innovative aspect of an example. Further, the exemplary illustrations described herein are not exhaustive or otherwise limiting, and embodiments are not restricted to the precise form and configuration shown in the drawings or disclosed in the following detailed description. Exemplary illustrations are described in detail by referring to the drawings as follows:

DETAILED DESCRIPTION

Reference will now be made in detail to embodiments of the present disclosure, examples of which are described herein and illustrated in the accompanying drawings. While the present disclosure will be described in conjunction with embodiments and/or examples, they do not limit the present disclosure to these embodiments and/or examples. On the contrary, the present disclosure covers alternatives, modifications, and equivalents.

Figure 1:
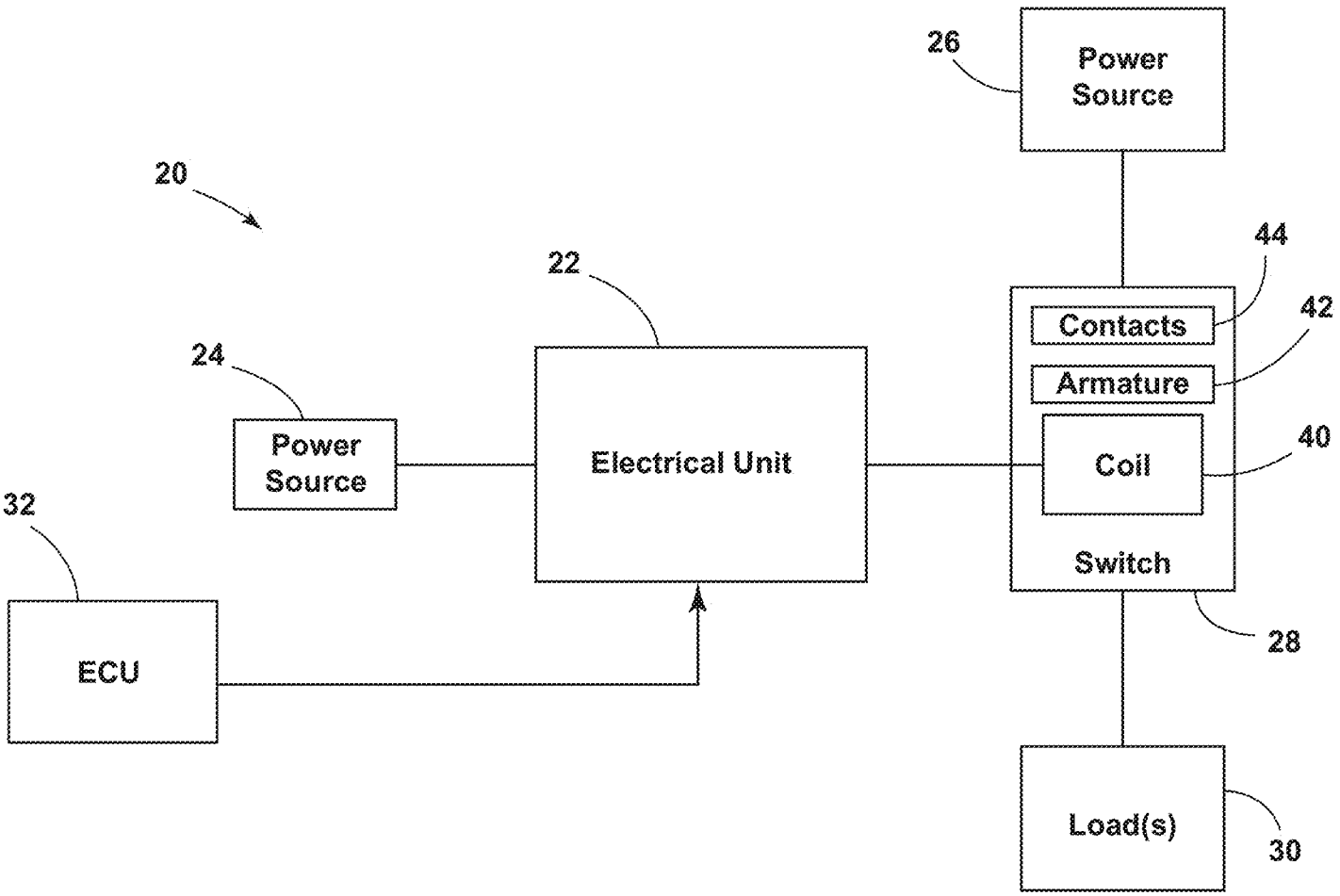
FIG. 1 is a diagram generally illustrating an embodiment of an electrical system according to teachings of the present disclosure.

In embodiments, such as generally illustrated in FIG. 1, an electrical system 20 may include an electrical unit 22, a first power source 24, a second power source 26, a switch 28 (e.g., a contactor, a relay, among others) one or more loads 30, and/or an electronic control unit (ECU) 32. The first power source 24 may include a low voltage power source. For example and without limitation, the first power source 24 may include a low voltage vehicle battery that may be configured to provide a voltage of about 12 V to about 14 V. The second power source 26 may include a high voltage power source. For example and without limitation, the second power source 26 may be configured to provide a voltage of at least about 48 V, which may include voltages up to and exceeding 800 V. The ECU 32 may be configured to control operation of the switch 28 via the electrical unit 22, such as to selectively provide power from the second power source 26 to the one or more loads 30. For example, the ECU 32 may be configured to provide a control signal to the electrical unit 22 to close the switch 28 and the electrical unit 22 may provide power from the first power source 24 to a coil 40 of the switch 28 to generate a magnetic field/force to move an armature 42 of the switch 28 into electrical contact with contacts 44 of the switch 28 and close the switch 28 to provide power from the second power source 26 to the one or more loads 30. An electrical load 30 may, for example and without limitation, include an electric motor, among other loads.

Figure 2:
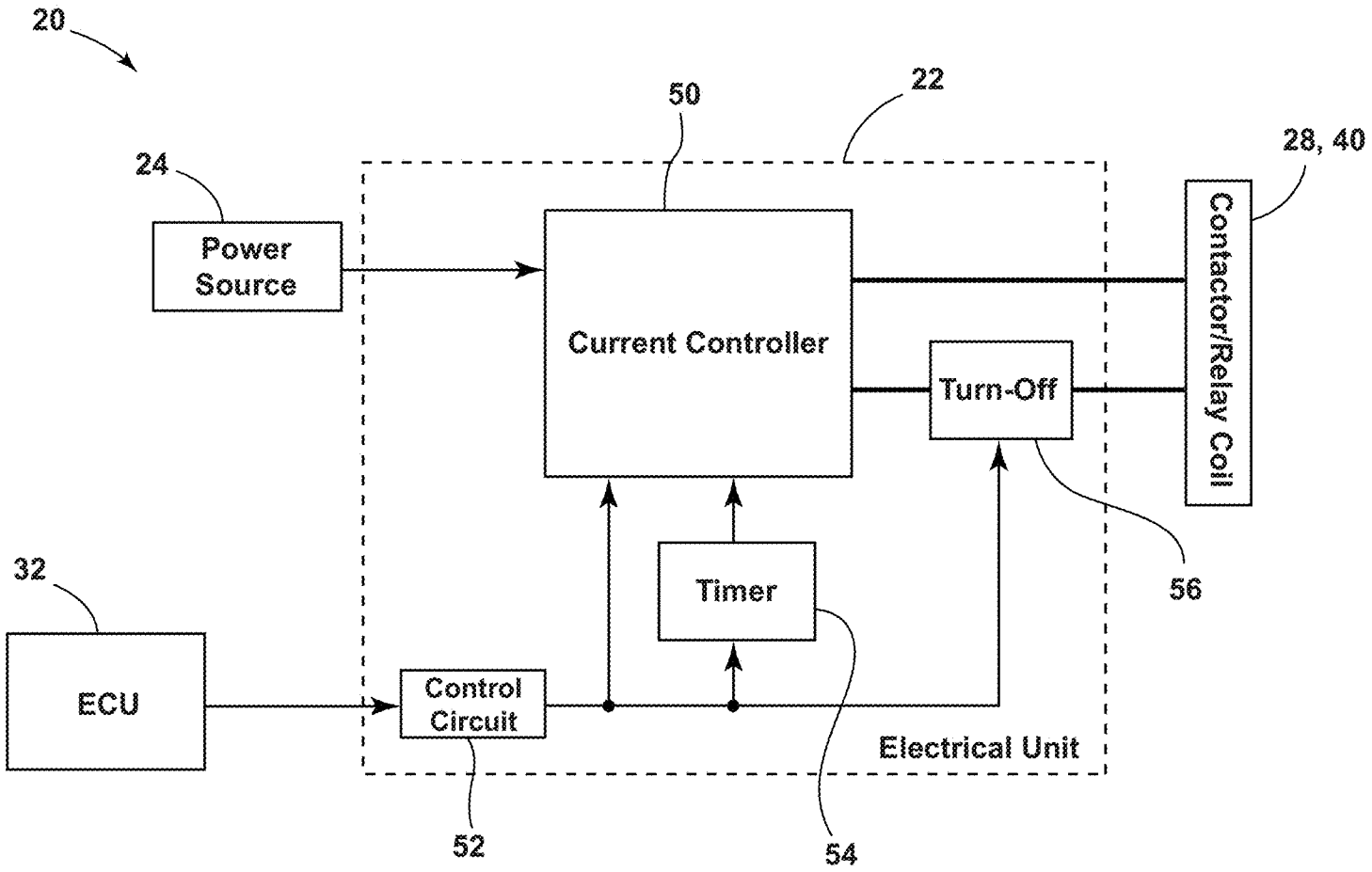
FIG. 2 is a diagram generally illustrating an embodiment of an electrical system according to teachings of the present disclosure.

With embodiments, such as generally illustrated in FIG. 2, an electrical unit 22 may include a current controller 50, a control circuit 52, a timer 54, and/or a turn-off circuit 56.

Figure 3:
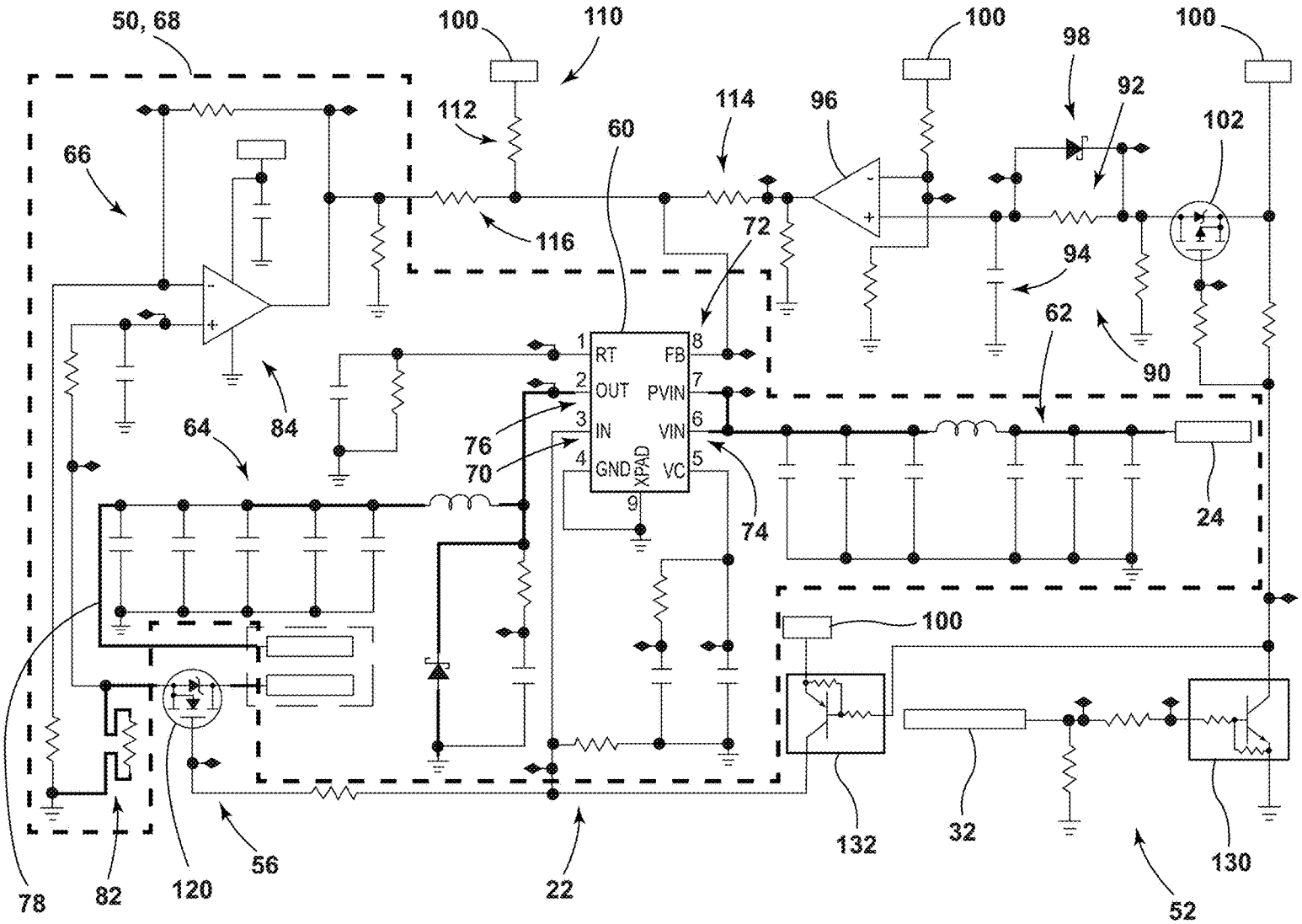
FIG. 3 is a diagram generally illustrating an embodiment of an electrical unit according to teachings of the present disclosure.

In embodiments, such as generally illustrated in FIG. 3, a current controller 50 may include an electrical regulator 60, a first filter 62, a second filter 64, and/or a feedback circuit 66. The current controller 50 may be configured to control the current provided to an electrical component, such as a switch 28, which may include providing one or more variable voltage output signals (e.g., DC voltages). The electrical regulator 60 may, for example, include a DC-DC buck/ step-down regulator and/or may include a first input 70, a second input 72, a third input 74, and/or an output 76. The first input 70 may be connected to the control circuit 52 and may be configured to receive a control circuit signal from the control circuit 52 and/or an ECU 32, such as to turn the electrical regulator 60 on or off. The second input 72 may be connected to the timer 54 and/or the feedback circuit 66. The third input 74 may be connected, at least indirectly, to a power source, such as the first power source 24 via the first filter 62. The output 76 may be connected to the switch 28, such as to a coil 40 of the switch 28 via the second filter 64.

In embodiments, an electrical regulator 60 may be configured to operate in a plurality of modes, such as a first mode, a second mode, and/or a third mode. In the first mode, the electrical regulator 60 may be configured to provide a first output signal that may correspond to a pull-in current of the switch 28 (e.g., a current sufficient to generate a large enough magnetic field/force via the coil 40 to move the armature 42 from a first position toward and/or to a second position. If the switch 28 is normally open, the first position may be an open position and the second position may be a closed position (e.g., in contact with the electrical contacts 44). If the switch 28 is normally closed, the first position may be a closed position and the second position may be an open position.

With embodiments, in a second mode, the electrical regulator 60 may be configured to provide a second output signal that may correspond to a hold current of the switch 28 (e.g., a current sufficient to generate a large enough magnetic field/force to hold the armature 42 in the second position). The second current may be less than the first current. For example and without limitation, the second current may be about 50% or less than the first current, such as about 33% or about 25% (or more or less).

In embodiments, in a third mode, the electrical regulator 60 may not provide substantially any output current, which may allow the armature to remain in and/or move toward the first position. For example, with a normally open configuration, when the electrical regulator 60 is in the third mode, the switch 28 may be open and/or shifting toward open.

With embodiments, such as generally illustrated in FIG. 3, a current controller 50 may include a feedback circuit 66. The feedback circuit 66 may include a current sensor 82, which include a shunt resistor, and/or an amplifier 84. The amplifier 84 may amplify the output/feedback of the current sensor 82 such as to scale it to an internal feedback reference of the electrical regulator 60. A gain of the amplifier 84 may, for example and without limitation, be about 2.5. The amplifier 84 may, at least indirectly, be connected to the second input 72 of the electrical regulator 60 such that the amplified feedback (e.g., a feedback circuit output) may be provided to the second input 72. The amplifier 84 may, for example and without limitation, include an operational amplifier. In some configurations, such as if the output of the current sensor 82 is sufficiently large (e.g., if a relatively large shunt resistor is used), the feedback circuit 66 may not include an amplifier.

Figure 4:
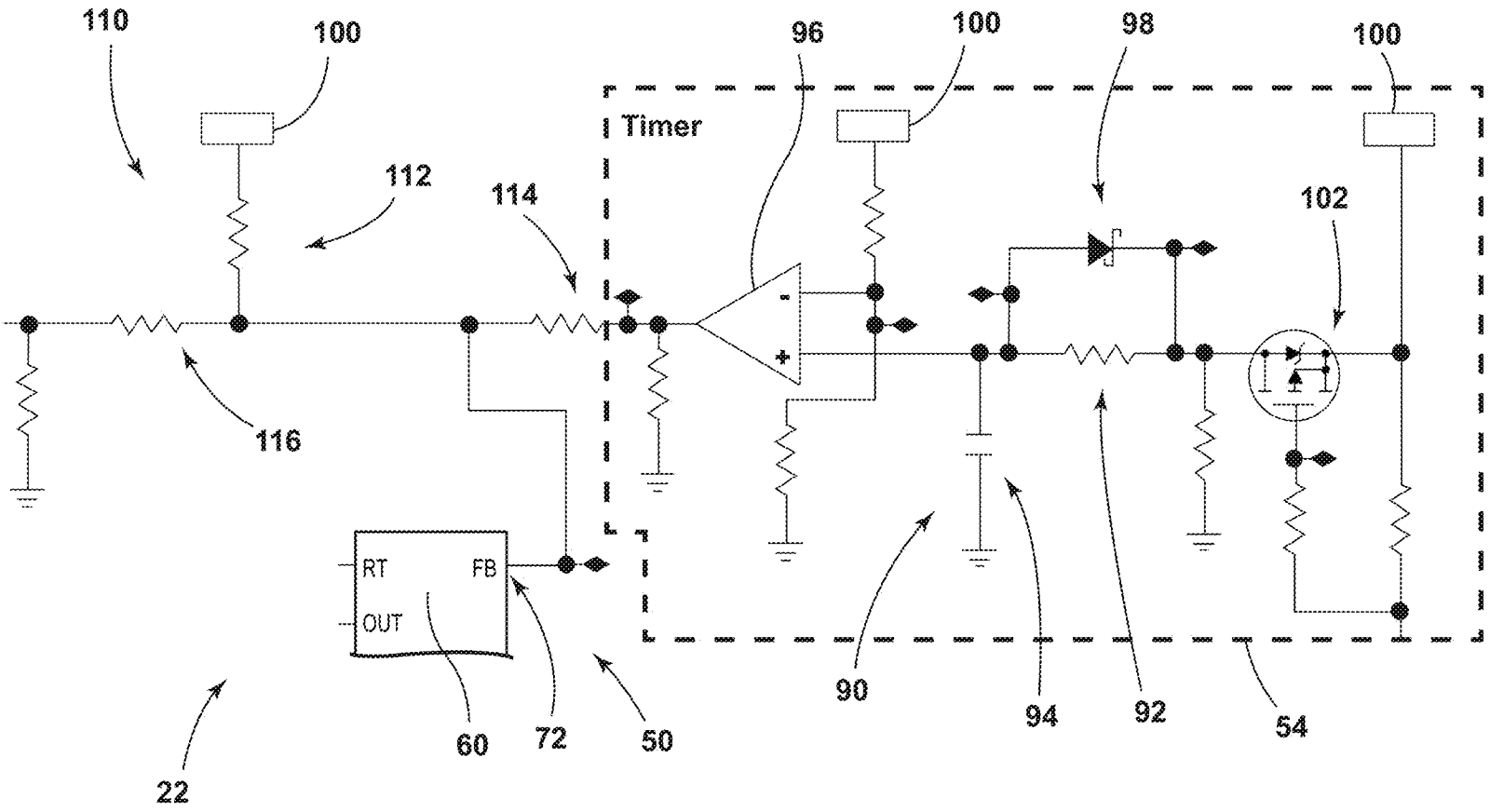
FIG. 4 is a diagram generally illustrating an embodiment of a timer of an electrical unit according to teachings of the present disclosure.

In embodiments, a timer 54 may be connected to the control circuit 52 such that the control circuit 52 may control when the timer 54 starts and/or when the timer 54 turns off (e.g., the control circuit 52 may activate/deactivate the timer 54). With embodiments, such as generally illustrated in FIG. 4, a timer 54 may include a RC circuit/timer 90, with a resistor 92 and a capacitor 94, a comparator 96, and/or a diode 98 (e.g., a Schottky diode). When the control circuit 52 activates the timer 54, the RC circuit 90 may be connected to a third power source 100, such as via a timer switch 102, which may start charging the capacitor 94. The voltage of the RC circuit 90 may be a first input to the comparator 96, and/or a power source, such as the third power source 100, may be a second input to the comparator 96. Initially, when the capacitor 94 is not charged or is still charging, the first input to the comparator 96 may be lower than the second input, so the comparator 96 may provide a low output (e.g., 0 V). Once the capacitor 94 is sufficiently charged such that the first input is at least as great as the second input, the comparator 96 may provide a high output (e.g., the voltage of the third power source 100, which may be about 5 V in some configurations). The amount of time for the capacitor 94 to charge (e.g., the timer period) may be dictated by the capacitor 94 (e.g., the size of the capacitor 94) and/or the third power source 100. The comparator 96 may, for example and without limitation, include an operational amplifier.

With embodiments, the diode 98 may be connected to facilitate discharging of the capacitor 94, such as when the timer is turned off. Facilitating discharging may allow for quick on/off cycles. For example, if the timer 54 is restarted before the capacitor 94 is fully discharged, the timer 54 may provide a high output too soon and the electrical regulator 60 may provide the second output signal too soon (e.g., before the armature 42 is connected with the contacts 44 and stable), which may result in the switch 28 failing to close or stay closed. The diode 98 may provide a current path for quickly discharging the capacitor 94, which may avoid and/or limit such issues.

In embodiments, an electrical unit 22 may include a resistor network 110. The resistor network 110 may be connected to the third power source 100, the second input 72 of the electrical regulator 60, the output of the timer 54, and/or the output of the feedback circuit 66. The resistor network 110 may include a plurality of resistors, such as resistors 112, 114, 116. In some embodiments, a first resistor 112 of the resistor network 110 may be connected a power source, such as the third power source 100, and/or may be connected to the second input 72 of the electrical regulator 60, such as in parallel with the feedback circuit 66 and/or the timer 54. A second resistor 114 may be connected to the output of the timer 54 and/or to the second input 72. A third resistor 116 may be connected to the output of the feedback circuit and/or to the second input 72.

With embodiments, the electrical regulator 60 may be configured to adjust its output to until it receives a feedback (e.g., at its second input 72) that is substantially equal to a reference voltage, which may, for example and without limitation, be about 0.8 V. The feedback circuit 66 and the resistor network 110 may be configured such that when a pull-in current is provided to the coil 40 and the timer 54 is providing a low output, the feedback circuit 66 and the resistor network 110 provide the reference voltage of the electrical regulator 60 to the second input 72 of the electrical regulator 60. If the current provided to the coil 40 (e.g., as sensed via the current sensor 82) is above the pull-in current, the feedback circuit 66 and the resistor network 110 may provide a voltage greater than the reference voltage, and the electrical regulator 60 may reduce its output (e.g., reduce the duty cycle, if the output includes a pulse-width modulated (PWM) signal) until the pull-in current is reached. If the current provided to the coil 40 (e.g., as sensed via the current sensor 82) is below the pull-in current, the feedback circuit 66 and the resistor network 110 may provide a voltage lower than the reference voltage, and the electrical regulator 60 may increase its output (e.g., increase the duty cycle, if the output includes a PWM signal) until the pull-in current is reached.

In embodiments, when the timer 54 provides a high output (e.g., after the pull-in period), the output of the timer 54 may be combined with the output of the feedback circuit 66 via the resistor network 110 and provided to the second input 72 of the electrical regulator 60. This combination may increase the voltage provided to the second input 72 above the reference voltage, which may cause the electrical regulator 60 to decrease its output. For example and without limitation, the timer output may modify the feedback circuit output to modify the behavior of the electrical regulator 60. The resistor network 110 may be configured such that when hold current is provided to the coil 40 and the timer 54 is providing a high output, the timer 54, the feedback circuit 66, and the resistor network 110 cooperate to provide the reference voltage of the electrical regulator 60 to the second input 72 of the electrical regulator 60. For example, when the pull-in period ends, the electrical regulator 60 may decrease its output until the current in the coil 40 is substantially equal to the hold current.

Figure 5:
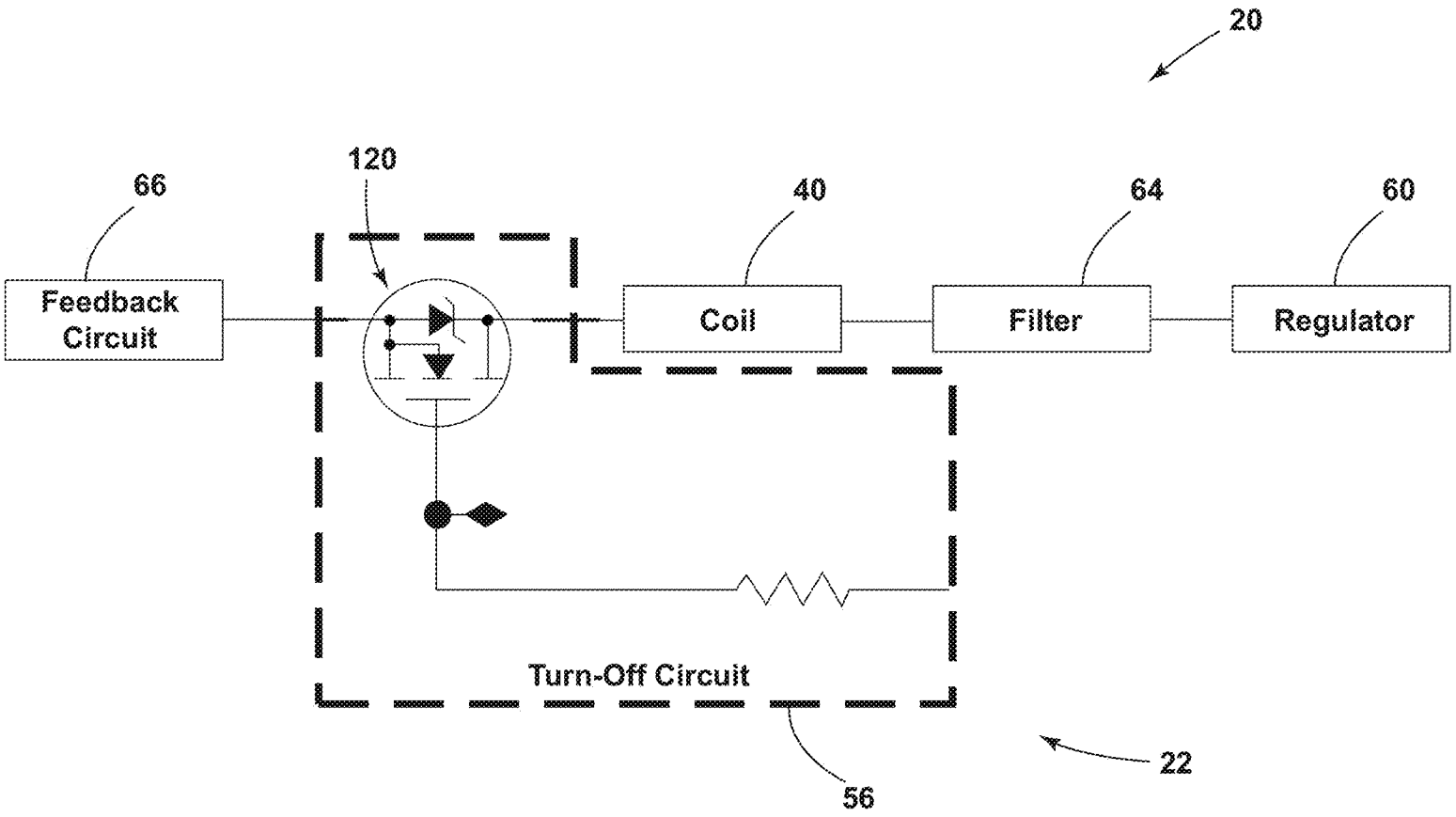
FIG. 5 is a diagram generally illustrating an embodiment of a turn-off circuit of an electrical unit according to teachings of the present disclosure.

In embodiments, such as generally illustrated in FIG. 5, a turn-off circuit 56 may include a turn-off switch 120. The turn-off switch 120 may be connected to the coil 40 of the switch 28. When the control circuit 52 is activated, such as via an ECU 32, the control circuit 52 may activate the turn-off switch 120, which may close the turn-off switch 120 to allow current to flow through the coil 40 to open and/or close the switch 28. The coil 40 may act as a large inductor, so it may be desirable to discharge the coil 40 quickly to allow for the switch 28 to change from the second position to the first position quickly (e.g., if the coil 40 is not discharged quickly, the coil 40 may dissipate stored energy via a magnetic field that restricts movement of the armature 42 toward the first position). When the control circuit 52 deactivates the turn-off switch 120, the turn-off switch 120 may be configured to quickly discharge the coil 40. For example, the turn-off switch 120 may include an avalanche MOSFET (e.g., a MOSFET with a high avalanche breakdown voltage, which may be provided, at least in part, via a transient-voltage-suppression (TVS) diode). The breakdown voltage may, for example and without limitation, be about 40 V or more. The turn-off circuit 56 may be connected between the coil 40 and the feedback circuit 66.

Figure 6:
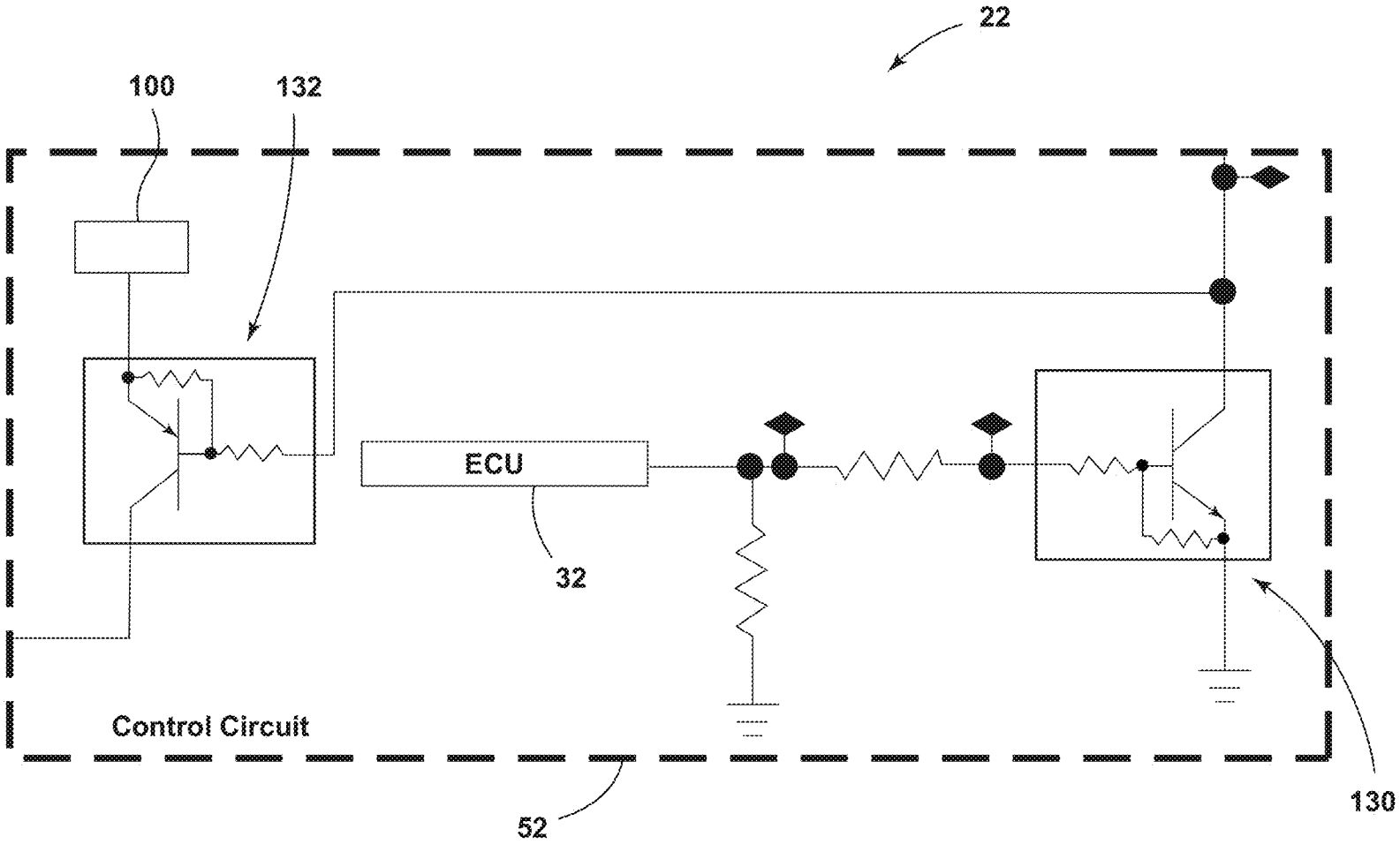
FIG. 6 is a diagram generally illustrating an embodiment of a control circuit of an electrical unit according to teachings of the present disclosure.
Figure 7:
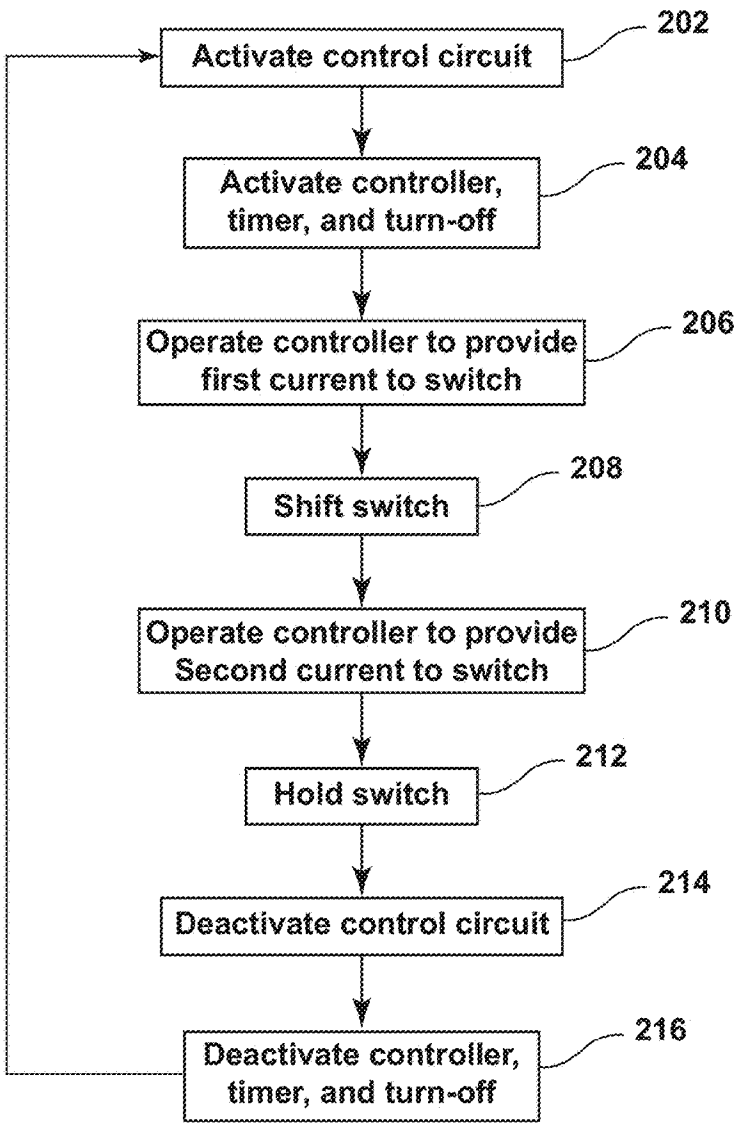
FIG. 7 is a flow chart generally illustrating an embodiment of a method of operating an electrical system according to teachings of the present disclosure.

In embodiments, such as generally illustrated in FIG. 6, a control circuit 52 may include a first control switch 130 and/or a second control switch 132. The first control switch 130 may be configured to receive a control signal, such as from an ECU 32. Upon receiving the control signal, the first control switch 130 may close, which may provide power, such a from the third power source 100, to the second control switch 132 and/or to the timer 54 (e.g., to the timer switch 102). Providing power to the second control switch 132 may close the second control switch 132, which may provide power from a power source, such as the third power source 100, to the current controller 50 (e.g., to the first input 70 of the electrical regulator 60) and/or to the turn-off circuit 56 (e.g., to the turn-off switch 120). With such a configuration, the control circuit 52 may, substantially simultaneously, activate the current controller 50, the timer 54, and the turn-off circuit 56, which may at least start shifting the switch 28 from a first state (e.g., a normal/rest state) to a second state (e.g., an activated state). If the control circuit 52 stops receiving the control signal and/or the control signal is low, the first control switch 130 may open, which may deactivate the timer 54 and/or the second control switch 132, which may deactivate the current controller 50, the electrical regulator 60, and/or the turn-off circuit 56. For example and without limitation, the control circuit 52 may, substantially simultaneously, deactivate the current controller 50, the timer 54, and the turn-off circuit 56, which may efficiently shift the switch 28 from the second state to the first state, which may deactivate (or activate, if switch 28 is normally-closed) one or more loads 30. The first control switch 130 may, for example and without limitation, include a pre-biased NPN bipolar junction transistor (BJT). The second control switch 132 may, for example and without limitation, include a pre-biased PNP BJT.

With embodiments, a method 200 of operating an electrical system 20 may include activating a control circuit 52 (block 202), such via an ECU 32 providing a control/activation signal to the control circuit 52. The control circuit 52 may activate a current controller 50, a timer 54, and/or a turn-off circuit 56 (block 204), which may include activating a first control switch 130 of the control circuit 52, which may activate a second control switch 132 of the control circuit 52 and/or a switch 102 of the timer 54. Activating the second control switch 132 may activate an electrical regulator 60 of the current controller 50 and/or may activate (e.g., close) a turn-off switch 120 of the turn-off circuit 56.

In embodiments, the method 200 may include operating the current controller 50 to provide a first current to a switch 28 (e.g., a contactor, a relay, etc.) (block 206). Operating the current controller 50 to provide the first current may include the timer 54 providing a low output, an electrical regulator 60 providing a high output (e.g., a PWM signal with a high and/or full duty cycle) to a second/output filter 64, providing the filtered high output (e.g., a DC voltage) to a coil 40 of the switch 28, and/or a feedback circuit 66 providing feedback from the coil 40 to the electrical regulator 60. Providing feedback from the coil 40 may include sensing a current of the coil 40 (e.g., via a current sensor 82), amplifying the sensed current via an amplifier 84, and/or providing the amplified sensed current to the electrical regulator 60, such as via resistor network 110. With embodiments, the switch 28 may have an associated pull-in current and/or hold current. While the timer 54 provides a low output (e.g., during the pull-in period/until the capacitor 94 is charged), the feedback circuit 66 and the resistor network 110 may provide a voltage that is substantially equal to the reference voltage of the electrical regulator 60 to a second input 72 of the electrical regulator 60 when the coil current is substantially equal to the pull-in current. The electrical regulator 60 may increase or decrease its output until the pull-in current is reached.

In embodiments, providing the first current to the switch 28 may shift the switch 28 from a first state to toward and/or to a second state (block 208). For example, with a normally-open switch 28, providing the first current to the switch 28 may shift the switch 28 from an open state to a closed state in which the switch 28 may provide power from a second power source 26 to one or more electrical loads 30.

With embodiments, the method 200 may include operating the current controller 50 to provide a second current (e.g., a hold current) to the switch 28 (block 210), such as after the pull-in period. Operating the current controller 50 to provide the second current to the switch 28 may include the timer 54 providing a high output (e.g., a voltage of the third power source 100), which may be combined with the output of the feedback circuit 66 via the resistor network 110 and provided to the second input 72 of the electrical regulator 60. The combined voltage may, at least initially, be greater than the reference voltage of the electrical regulator 60 so the electrical regulator 60 may decrease its output. The timer 54, the feedback circuit 66, and/or the resistor network 110 may be configured such that the electrical regulator 60 decreases its output until the coil current is substantially equal to the hold current. Providing the second current to the switch 28 may hold the switch 28 in the second state (block 212).

In embodiments, the method 200 may include deactivating the control circuit 52 (block 214). Deactivating the control circuit 52 may deactivate the current controller 50, the timer 54, and/or the turn-off circuit 56 (block 216), such as via opening the first control switch 130, which may open the timer switch 102 and/or the second control switch 132. Opening the second control switch 132 may deactivate the electrical regulator 60 and/or open the turn-off switch 120. Opening the timer switch 102 may discharge a capacitor 94 of the timer 54. Opening the turn-off switch 120 may discharge a coil 40 of the switch 28.

With embodiments, a resistance of a coil 40 of a switch 28 may vary with temperature, which may change a voltage associated with pull-in and hold currents, which may remain relatively constant with temperature changes. For example, if the temperature of the coil 40 increases, the associated increase in resistance of the coil 40 may increase a voltage to obtain the pull-in and hold currents. Embodiments of an electrical system 20, an electrical unit 22, and/or a method 200 may be configured to automatically compensate for changes in temperature. For example, the output of the current controller 50 may operate to provide a variable output according to the (measured) current of the coil 40 (e.g., via the feedback circuit output) so the electrical unit 22 may provide sufficient voltage to maintain the pull-in and hold currents even with wide ranges of temperatures (e.g., −40 C. to 130 C.) that may cause changes to the resistance of the coil 40. The electrical regulator 60 may, for example, include a voltage regulator controlled according to coil current (e.g., instead of coil voltage).

With some embodiments, an electrical unit 22 may not include any software (e.g., may be a hardware-only unit). For example, an ECU 32 may include software that may provide a control signal to the electrical unit 22, but the electrical unit 22 itself may not include any software or processors, at least in some configurations.

In some configurations, one or more (or all) components of an electrical unit 22 may be connected to a circuit board 68, components but are not required to be connected to a circuit board or the same circuit board.

Interference generated when controlling a switch 28 may be relatively low for some applications, such as applications where an electrical unit 22 is disposed relatively close to the switch 28 (e.g., connected to the same circuit board). However, with some applications, the switch 28 may be disposed at a significant distance (e.g., one third of a meter, one half of a meter, one meter, or more) from an electrical unit 22, a current controller 50, and/or an electrical regulator 60.

With other designs (e.g., chopper-based designs), significant interference may be generated in such a configuration, such as because of high frequency switching. With embodiments of the system 20 and/or the electrical unit 22 (and/or method 200), interference may be significantly reduced compared to such other designs. For example, a second filter 64 may be connected to the output 76 of the electrical regulator 60, which may convert the output (e.g., a PWM signal) to a DC voltage, and the DC voltage may be provided to the switch 28, at least in part, via a wire/cable 78. The electrical regulator 60 and the second filter 64 may be disposed in proximity to each other, such as, for example and without limitation, within 10 cm of each other and/or on the same circuit board 68. The wire/cable 78 may be significantly longer than the distance between the electrical regulator 60 and the second filter 64. For example and without limitation, the wire/cable 78 may be at least 10, 50, and/or 100 (or more or fewer) times longer than the distance between the electrical regulator 60 and the second filter 64. The distance between the electrical regulator 60 and the second filter 64 may be minimized and may, in some examples, be about 1 cm or less. With such configurations, interference generated via the output signal may be limited as the length of the transmission of the switching signal may be limited.

In examples, an ECU (e.g., ECU 32) may include an electronic controller and/or include an electronic processor, such as a programmable microprocessor and/or microcontroller. In embodiments, an ECU may include, for example, an application specific integrated circuit (ASIC). An ECU may include a central processing unit (CPU), a memory (e.g., a non-transitory computer-readable storage medium), and/or an input/output (I/O) interface. An ECU may be configured to perform various functions, including those described in greater detail herein, with appropriate programming instructions and/or code embodied in software, hardware, and/or other medium. In embodiments, an ECU may include a plurality of controllers. In embodiments, an ECU may be connected to a display, such as a touchscreen display.

Various examples/embodiments are described herein for various apparatuses, systems, and/or methods. Numerous specific details are set forth to provide a thorough understanding of the overall structure, function, manufacture, and use of the examples/embodiments as described in the specification and illustrated in the accompanying drawings. It will be understood by those skilled in the art, however, that the examples/embodiments may be practiced without such specific details. In other instances, well-known operations, components, and elements have not been described in detail so as not to obscure the examples/embodiments described in the specification. Those of ordinary skill in the art will understand that the examples/embodiments described and illustrated herein are non-limiting examples, and thus it can be appreciated that the specific structural and functional details disclosed herein may be representative and do not necessarily limit the scope of the embodiments.

Reference throughout the specification to "examples, "in examples," "with examples," "various embodiments," "with embodiments," "in embodiments," or "an embodiment," or the like, means that a particular feature, structure, or characteristic described in connection with the example/embodiment is included in at least one embodiment. Thus, appearances of the phrases "examples, "in examples," "with examples," "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more examples/embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or nonfunctional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of examples/embodiments.

Joinder references (e.g., attached, coupled, connected, and the like) are to be construed broadly and may include intermediate members between a connection of elements, relative movement between elements, direct connections, indirect connections, fixed connections, movable connections, operative connections, indirect contact, and/or direct contact. As such, joinder references do not necessarily imply that two elements are directly connected/coupled and in fixed relation to each other. Connections of electrical components, if any, may include mechanical connections, electrical connections, wired connections, and/or wireless connections, among others. The use of "e.g." and "such as" in the specification are to be construed broadly and are used to provide non-limiting examples of embodiments of the disclosure, and the disclosure is not limited to such examples or such types of examples. Uses of "and" and "or" are to be construed broadly (e.g., to be treated as "and/or"). For example and without limitation, uses of "and" do not necessarily require all elements or features listed, and uses of "or" are inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

All matter contained in the above description or shown in the accompanying drawings shall be interpreted as illustrative only and not limiting. Changes in detail or structure may be made without departing from the present disclosure.

What is claimed is:

1. An electrical unit, comprising:

a current controller including an electrical regulator;

a control circuit connected to a first input of the electrical regulator and including at least one control switch;

a timer connected to a second input of the electrical regulator; and a turn-off circuit including a turn-off switch;

wherein the current controller is configured to provide a first output signal in a first mode and a second output signal in a second mode;

the current controller is configured to transition from the first mode to the second mode based on a timer output of the timer; and the turn-off switch is configured to discharge a coil and includes an avalanche MOSFET having a breakdown voltage of at least 40 V.

2. The electrical unit of claim 1, wherein the first output signal is configured to provide a pull-in current to a coil of a switch and the second output signal is configured to provide a hold current to the coil of the switch.

3. The electrical unit of claim 1, including a resistor network connected to the current controller and the timer;

wherein the timer includes an RC circuit and a comparator.

4. The electrical unit of claim 3, wherein the timer includes a Schottky diode connected in parallel with a resistor of the RC circuit to facilitate discharging of a capacitor of the RC circuit and restarting of the timer.

5. The electrical unit of claim 3, wherein the comparator includes a first comparator input, a second comparator input, and a comparator output;

the first comparator input is connected to the RC circuit;

the second comparator input is connected to a power source; and the comparator output is connected to the resistor network and the current controller.

6. The electrical unit of claim 1, wherein the control circuit is configured to activate the current controller, the timer, and a turn-off circuit.

7. The electrical unit of claim 1, wherein the current controller includes a feedback circuit; and the feedback circuit is connected to the second input of the electrical regulator via a resistor network.

8. The electrical unit of claim 7, wherein the electrical regulator includes a DC-DC step-down voltage regulator; and the feedback circuit provides a feedback circuit output corresponding to a current of a coil of a switch.

9. The electrical unit of claim 8, wherein the feedback circuit includes an amplifier; and the feedback circuit includes a shunt resistor configured to obtain information about the current of the coil of the switch.

10. The electrical unit of claim 1, including a resistor network connected to the timer and the current controller; and a turn-off circuit including a turn-off switch configured to facilitate discharging a coil;

wherein the electrical regulator includes a DC-DC step-down regulator;

the timer includes an RC circuit and a comparator;

the timer includes a Schottky diode connected to facilitate restarting of the timer;

the comparator includes a first comparator input, a second comparator input, and a comparator output;

the first comparator input is connected to the RC circuit;

the second comparator input is connected to a power source;

the comparator output is connected to the resistor network and the current controller;

the turn-off switch includes an avalanche MOSFET;

the control circuit is configured control the current controller, the timer, and the turn-off circuit substantially simultaneously;

the current controller includes a feedback circuit;

the feedback circuit includes an amplifier; and the feedback circuit and the timer are connected to the second input of the electrical regulator via the resistor network.

11. An electrical system, comprising:

the electrical unit of claim 1;

a switch connected to the electrical unit, the switch including a coil; and an LC filter connected to an output of the electrical regulator and configured to convert the first output signal and the second output signal from pulse-width modulated (PWM) signals to DC voltage signals;

wherein the electrical unit is configured to provide the first output signal to the coil in the first mode and provide the second output signal to the coil in the second mode to limit power consumption associated with controlling the switch; the LC filter and the electrical regulator are disposed a distance apart; the LC filter is connected to the switch via a wire or cable; and a length of the wire or cable is at least 10 times longer than the distance.

12. An electrical system, comprising:

the electrical unit of claim 1;

a switch connected to the electrical unit, the switch including a coil;

a first power source connected to the electrical unit;

a second power source connected to the switch;

an electronic control unit connected to the electrical unit; and an electric load connected to the switch;

wherein the electrical unit is configured to provide the first output signal to the coil in the first mode and provide the second output signal to the coil in the second mode to limit power consumption associated with controlling the switch.

13. The electrical system of claim 12, wherein the electronic control unit is configured to provide a switch control signal to the electrical unit;

in response to receiving the switch control signal, the control circuit of the electrical unit is configured to activate the timer and the current controller such that the current controller operates in the first mode to provide the first output signal to the coil; and after a timer period of the timer, the timer is configured to provide the timer output to cause the current controller to operate in the second mode and provide the second output signal to the coil.

14. A method of operating the electrical system of claim 12, the method comprising:

providing, via the electronic control unit, a switch control signal to the electrical unit;

activating, via the control circuit, the timer and the current controller;

providing, via the current controller, the first output signal to the coil to shift the switch from a first state to a second state; and providing, via the current controller after a timer period, the second output signal to the coil to hold the switch in the second state.

15. The method of claim 14, wherein providing the second output signal includes automatically compensating for temperature changes by adjusting the second output signal according to a current of the coil.

16. The method of claim 14, wherein the electrical unit includes a feedback circuit; and providing the second output signal includes modifying a feedback circuit output with the timer output to the electrical regulator.

17. The method of claim 16, wherein the second output signal has a lower voltage than the first output signal to reduce a current in the coil from a pull-in current to a hold current and reduce power consumption.

18. A method of operating the electrical system of claim 11, the method comprising:

operating the current controller to provide the first output signal and the second output signal according to a combination of a feedback circuit output and the timer output;

wherein the feedback circuit output corresponds to a current of the coil.

* * * * *